US006353985B1

(12) United States Patent
Hill et al.

(10) Patent No.: US 6,353,985 B1
(45) Date of Patent: Mar. 12, 2002

(54) FABRIC-THREADING TOOL

(76) Inventors: Ruth Ann Hill; Joyce Lanier, both of 40 Cayuga St., Hartwell, GA (US) 30643

( * ) Notice: Subject to any disclaimer, the term of this patent is extended or adjusted under 35 U.S.C. 154(b) by 0 days.

(21) Appl. No.: 09/887,244

(22) Filed: Jun. 22, 2001

(51) Int. Cl.[7] ..... B65H 57/16

(52) U.S. Cl. ..... 28/212; 28/199

(58) Field of Search ..... 28/172.1, 172.2, 28/208, 212, 190, 193, 194, 196, 198, 199, 213, 149, 151, 152, 207.1, 201; 66/1 A, 125 R; 242/157 R, 615, 615.3; 139/192, 1 R, 97, 35, 380, 381; 2/908, 920

(56) References Cited

U.S. PATENT DOCUMENTS

| | | | | | |
|---|---|---|---|---|---|
| 21,488 | A | * | 9/1858 | Corey | 28/212 |
| 76,246 | A | * | 3/1868 | Powers | 28/172.1 |
| 84,793 | A | * | 12/1868 | Bayden | 28/212 |
| 278,873 | A | * | 6/1883 | Cadigon | 28/212 |
| 305,502 | A | * | 9/1884 | Berckmans | 28/212 |
| 344,093 | A | * | 6/1886 | Entwistle | 28/199 |
| 345,029 | A | | 7/1886 | Cole | |
| 349,440 | A | | 9/1886 | Looker | |
| 790,077 | A | * | 5/1905 | Rhoades | 28/212 |
| 1,153,870 | A | * | 9/1915 | Lea | 28/212 |
| 1,527,928 | A | * | 2/1925 | Scott | 28/212 |
| 2,074,264 | A | | 3/1937 | Karle | |
| 2,279,098 | A | * | 4/1942 | Wattie | 28/199 |
| 2,726,434 | A | | 12/1955 | Knoblock et al. | |
| 3,054,277 | A | | 9/1962 | Broschard | |
| 3,279,008 | A | | 10/1966 | Wallach | |
| 3,821,543 | A | * | 6/1974 | Gelin et al. | 242/42 |
| 4,894,892 | A | * | 1/1990 | Duda | 28/172.1 |

* cited by examiner

*Primary Examiner*—Amy B. Vanatta

(57) ABSTRACT

A fabric-threading tool for facilitating the setup of a thread mill warp machine. The fabric-threading tool includes a base member with a plurality of slots designed for receiving fabric threads. The threads are held in place by a cover strap which is selectively couplable to the surface of the base member having the slots.

6 Claims, 4 Drawing Sheets

FABRIC-THREADING TOOL

BACKGROUND OF THE INVENTION

1. Field of the Invention

The present invention relates to fabric-threading tools and more particularly pertains to a new fabric-threading tool for facilitating the setup of a thread mill warp machine.

2. Description of the Prior Art

The use of fabric-threading tools is known in the prior art. More specifically, fabric-threading tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,054,277; 2,074,264; 3,279,008; 2,074,264; 345,029; 2,726,434; and 349,440.

While these devices fulfill their respective, particular objectives and requirements, the aforementioned patents do not disclose a new fabric-threading tool. The inventive device includes a base member with a plurality of slots designed for receiving fabric threads. The threads are held in place by a cover strap which is selectively couplable to the surface of the base member having the slots.

In these respects, the fabric-threading tool according to the present invention substantially departs from the conventional concepts and designs of the prior art, and in so doing provides an apparatus primarily developed for the purpose of facilitating the setup of a thread mill warp machine.

SUMMARY OF THE INVENTION

In view of the foregoing disadvantages inherent in the known types of fabric-threading tools now present in the prior art, the present invention provides a new fabric-threading tool construction wherein the same can be utilized for facilitating the setup of a thread mill warp machine.

The general purpose of the present invention, which will be described subsequently in greater detail, is to provide a new fabric-threading tool apparatus and method which has many of the advantages of the fabric-threading tools mentioned heretofore and many novel features that result in a new fabric-threading tool which is not anticipated, rendered obvious, suggested, or even implied by any of the prior art fabric-threading tools, either alone or in any combination thereof.

To attain this, the present invention generally comprises a base member with a plurality of slots designed for receiving fabric threads. The threads are held in place by a cover strap which is selectively couplable to the surface of the base member having the slots.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fabric-threading tool apparatus and method which has many of the advantages of the fabric-threading tools mentioned heretofore and many novel features that result in a new fabric-threading tool which is not anticipated, rendered obvious, suggested, or even implied by any of the prior art fabric-threading tools, either alone or in any combination thereof.

It is another object of the present invention to provide a new fabric-threading tool which may be easily and efficiently manufactured and marketed.

It is a further object of the present invention to provide a new fabric-threading tool which is of a durable and reliable construction.

An even further object of the present invention is to provide a new fabric-threading tool which is susceptible of a low cost of manufacture with regard to both materials and labor, and which accordingly is then susceptible of low prices of sale to the consuming public, thereby making such fabric-threading tool economically available to the buying public.

Still yet another object of the present invention is to provide a new fabric-threading tool which provides in the apparatuses and methods of the prior art some of the advantages thereof, while simultaneously overcoming some of the disadvantages normally associated therewith.

Still another object of the present invention is to provide a new fabric-threading tool for facilitating the setup of a thread mill warp machine.

Yet another object of the present invention is to provide a new fabric-threading tool which includes a base member with a plurality of slots designed for receiving fabric threads. The threads are held in place by a cover strap which is selectively couplable to the surface of the base member having the slots.

Still yet another object of the present invention is to provide a new fabric-threading tool that securely holds a group of threads, allowing the group of threads to be physically moved over to the thread mill warp machine without intertwining of the thread members.

Even still another object of the present invention is to provide a new fabric-threading tool that is simple in design and use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
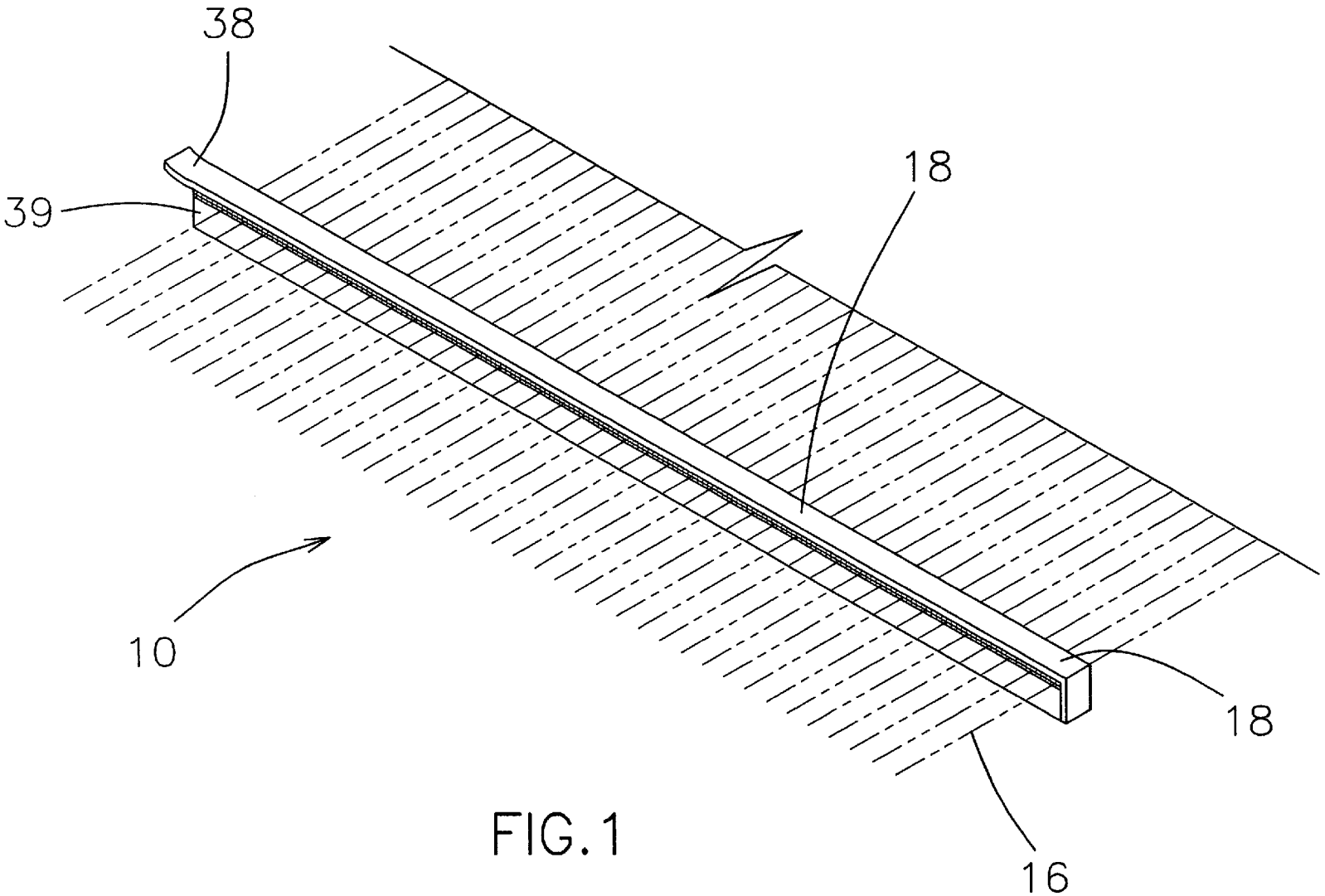
FIG. 1 is a schematic perspective view of a new fabric-threading tool according to the present invention.
Figure 2:
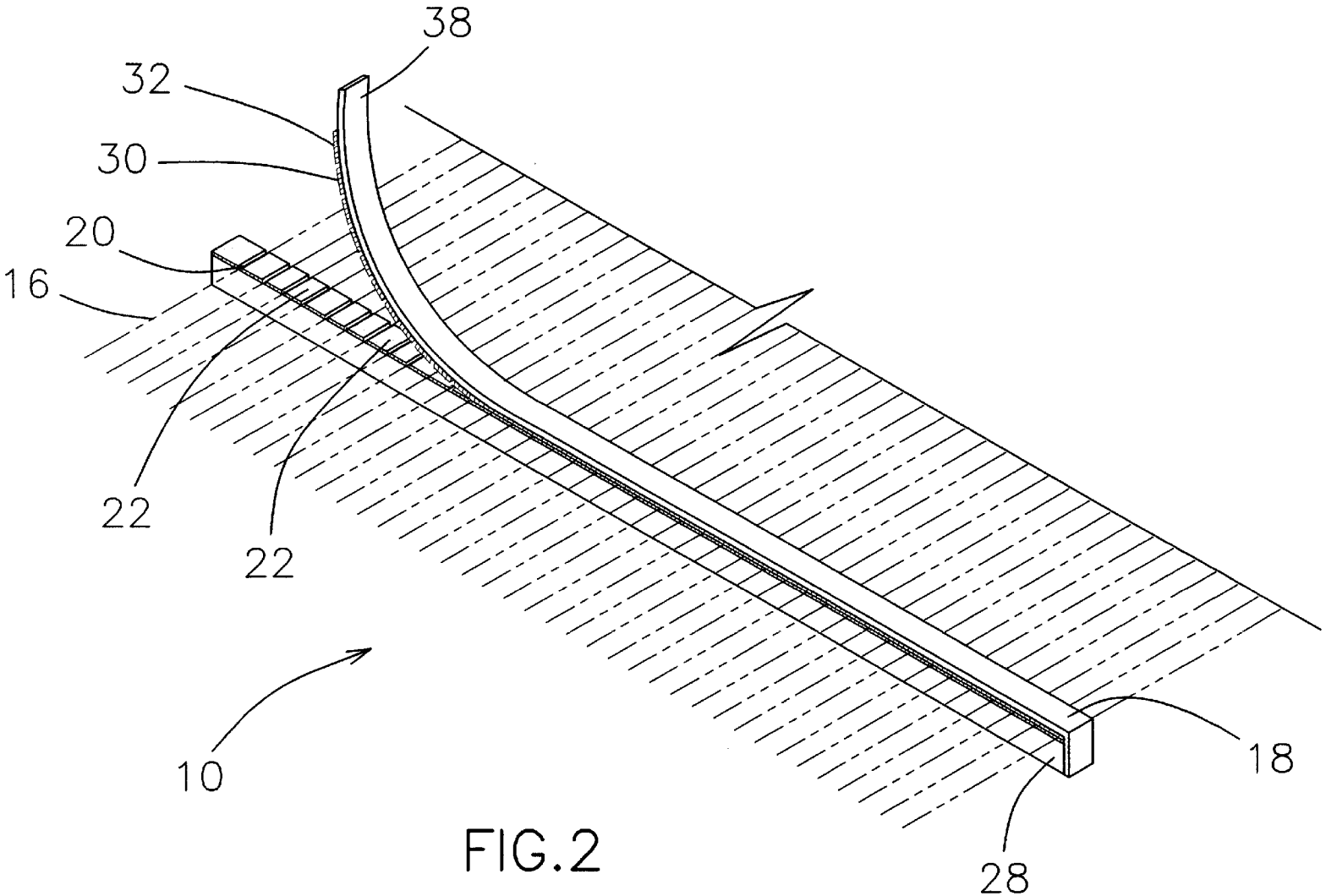
FIG. 2 is a schematic perspective view of the present invention with the cover strap partially separated from the base member.
Figure 3:
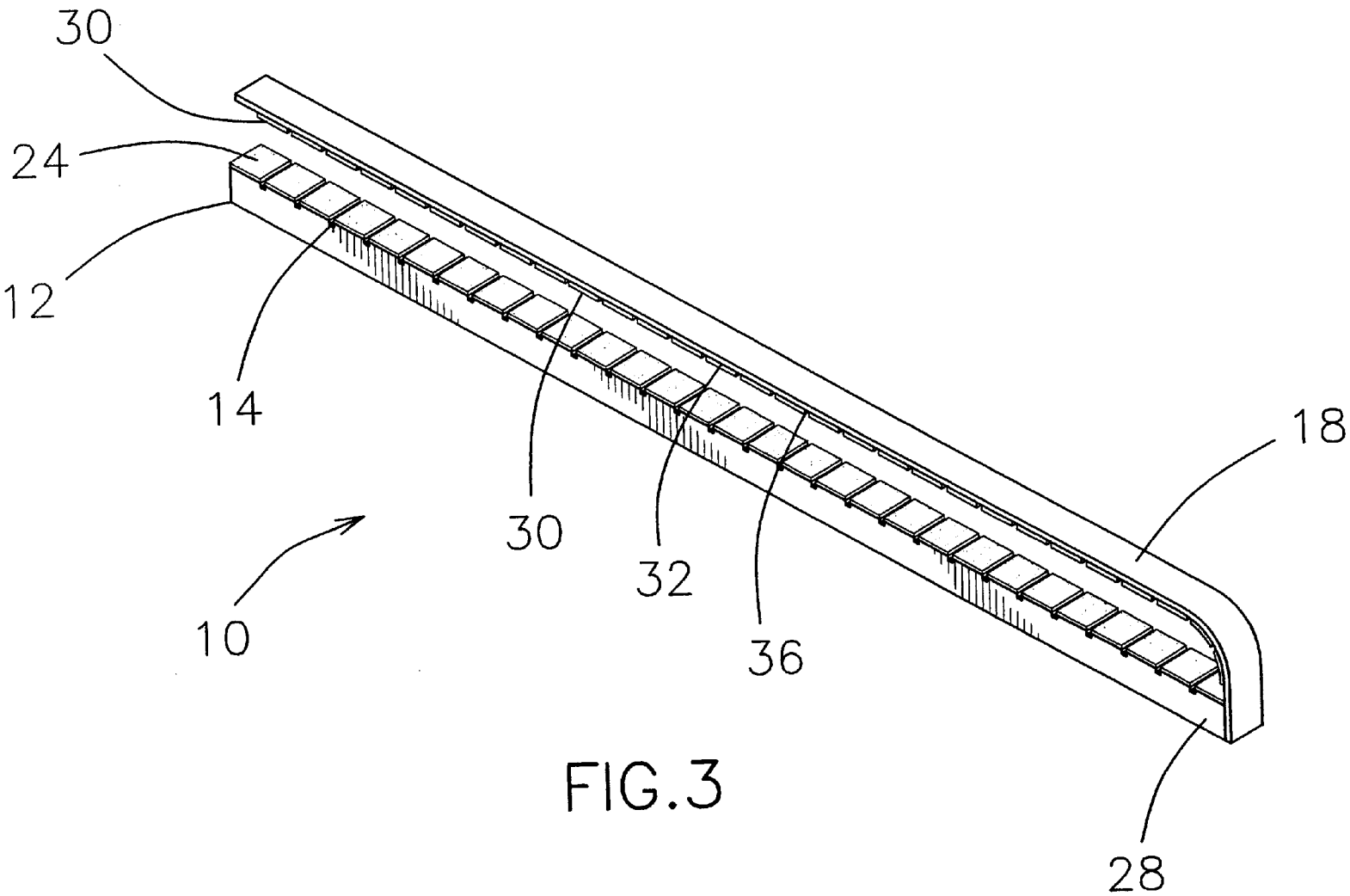
FIG. 3 is a schematic perspective view of the present invention with the cover strap completely separated from the base member with exception of the affixed ends.
Figure 4:
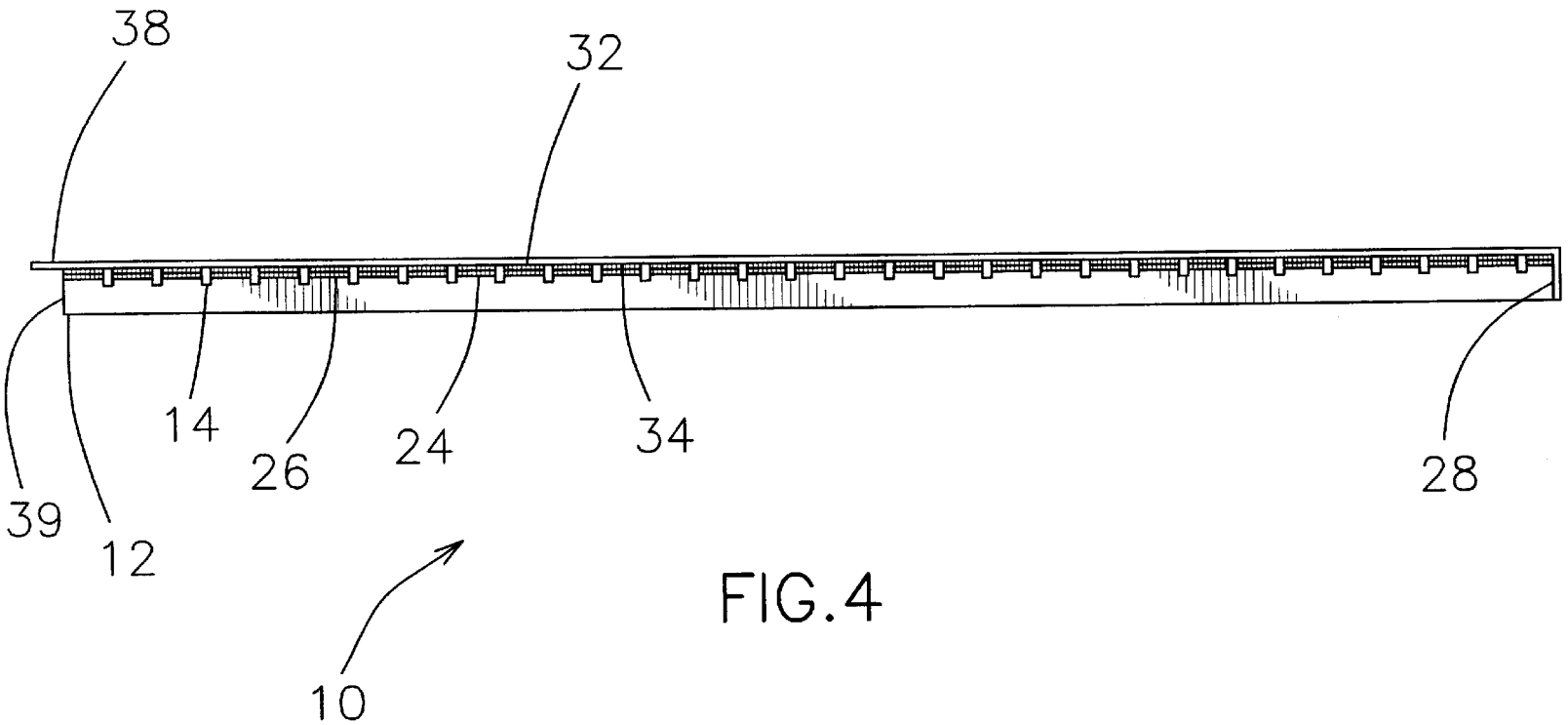
FIG. 4 is a schematic side view of the present invention.

With reference now to the drawings, and in particular to FIGS. 1 through 4 thereof, a new fabric-threading tool embodying the principles and concepts of the present invention and generally designated by the reference numeral 10 will be described.

As best illustrated in FIGS. 1 through 4, the fabric-threading tool 10 generally comprises an elongate base member 12 that includes a plurality of slots 14 for receiving fabric thread members 16.

A cover strap 18 is selectively couplable to a slot side 20 of the base member 12. A plurality of thread members 16 are captured in the slots 14 when the cover strap 18 is coupled to the base member 12, thereby allowing the thread members 16 to be moved in a uniform fashion for routing the thread members 16 into a thread mill warp machine.

The slots 14 are equally spaced on the slot side 20 of the base member 12 along a longitudinal axis of the base member 12. The slots 14 are substantially perpendicular to the longitudinal axis of the base member 12 such that the thread members 16 are prevented from becoming tangled.

The slot side 20 of the base member 12 includes a plurality of sections 22. The sections 22 are portions of the slot side 20 between the slots 14.

Each of the sections 22 includes a hook portion 24 of a hook and loop fastener fixedly coupled to a top surface 26 of the slot side 20 for being selectively couplable to the cover strap 18.

The cover strap 18 is fixedly coupled to a first end 28 of the base member 12 such that when the cover strap 18 is positioned over the base member 12 for coupling, the cover strap 18 and base member 12 are properly aligned.

The cover strap 18 includes a plurality of segments 30 of loop portions 32 of a hook and loop fastener fixedly coupled to a bottom surface 34 of the cover strap 18. The spaces 36 between the segments 30 are then substantially aligned with the slots 14 in the base member 12 when the cover strap 18 is selectively coupled to the base member 12.

A free end 38 of the cover strap 18 extends over a second end 39 of the base member 12. The free end 38 is for gripping onto by a user's hand to facilitate the separation of the cover strap 18 from the base member 12 upon completion of the insertion of all the thread members 16 into the tread mill warp machine.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A fabric-threading tool for facilitating the setup of a thread mill warp machine, the fabric-threading tool comprising:

an elongate base member, said base member having a plurality of slots for receiving fabric thread members; and a cover strap, said cover strap being selectively couplable to a slot side of said base member such that a plurality of thread members are captured in said slots when said cover strap is coupled to said base member, thereby allowing the thread members to be moved in a uniform fashion for routing the thread members into a thread mill warp machine.

2. The fabric-threading tool as set forth in claim 1, further comprising:

said slots being equally spaced on said slot side of said base member along a longitudinal axis of said base member, said slots being substantially perpendicular to the longitudinal axis of said base member such that the thread members are prevented from becoming tangled.

3. The fabric-threading tool as set forth in claim 2, further comprising:

said slot side of said base member having a plurality of sections, said sections being portions of said slot side between said slots; and each of said sections having a hook portion of a hook and loop fastener fixedly coupled to a top surface of said slot side for being selectively couplable to said cover strap.

4. The fabric-threading tool as set forth in claim 3, further comprising:

said cover strap being fixedly coupled to a first end of said base member such that when said cover strap is positioned over said base member for coupling, said cover strap and base member are properly aligned; and said cover strap having a plurality of segments of loop portions of a hook and loop fastener fixedly coupled to a bottom surface of said cover strap such that spaces between said segments are substantially aligned with said grooves in said base member when said cover strap is selectively coupled to said base member.

5. The fabric-threading tool as set forth in claim 4, further comprising:

a free end of said cover strap extending over a second end of said base member for gripping onto by a user's hand to facilitate the separation of said cover strap and said base member upon completion of the insertion of all the thread members into the thread mill warp machine.

6. A fabric-threading tool for facilitating the setup of a thread mill warp machine, the fabric-threading tool comprising:

an elongate base member, said base member having a plurality of slots for receiving fabric thread members;

a cover strap, said cover strap being selectively couplable to a slot side of said base member such that a plurality of thread members are captured in said slots when said cover strap is coupled to said base member, thereby allowing the thread members to be moved in a uniform fashion for routing the thread members into a thread mill warp machine;

said slots being equally spaced on said slot side of said base member along a longitudinal axis of said base member, said slots being substantially perpendicular to the longitudinal axis of said base member such that the thread members are prevented from becoming tangled;

said slot side of said base member having a plurality of sections, said sections being areas of said slot side between said slots;

each of said sections having a hook portion of a hook and loop fastener fixedly coupled to a top surface of said slot side for being selectively couplable to said cover strap;

said cover strap being fixedly coupled to a first end of said base member such that when said cover strap is swung over said base member for coupling, said cover strap and base member are properly aligned;

said cover strap having a plurality of segments of loop portions of a hook and loop fastener fixedly coupled to a bottom surface of said cover strap such that spaces between said segments are substantially aligned with said grooves in said base member when said cover strap is selectively coupled to said base member;

a free end of said cover strap extending over a second end of said base member for gripping onto by a user's hand to facilitate the separation of said cover strap and said base member upon completion of the insertion of all the thread members into the thread mill warp machine.

* * * * *